US008311809B2

(12) United States Patent
Schuijers et al.

(10) Patent No.: US 8,311,809 B2
(45) Date of Patent: Nov. 13, 2012

(54) CONVERTING DECODED SUB-BAND SIGNAL INTO A STEREO SIGNAL

(75) Inventors: Erik Gosuinus Petrus Schuijers, Eindhoven (NL); Marc Willem Theodorus Klein Middelink, Eindhoven (NL); Arnoldus Werner Johannes Oomen, Eindhoven (NL); Leon Maria Van De Kerkhof, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1700 days.

(21) Appl. No.: 10/552,772

(22) PCT Filed: Apr. 14, 2004

(86) PCT No.: PCT/IB2004/050436

§ 371 (c)(1),
(2), (4) Date: Oct. 12, 2005

(87) PCT Pub. No.: WO2004/093495

PCT Pub. Date: Oct. 28, 2004

(65) Prior Publication Data

US 2007/0112559 A1 May 17, 2007

(30) Foreign Application Priority Data

Apr. 17, 2003 (EP) ..... 03076134
Apr. 18, 2003 (EP) ..... 03076166

(51) Int. Cl.
*G10L 19/02* (2006.01)
*G10L 19/14* (2006.01)
*H04R 5/00* (2006.01)

(52) U.S. Cl. ..... 704/203; 704/205; 381/17

(58) Field of Classification Search ..... 704/204, 704/501, 502

See application file for complete search history.

(56) References Cited

U.S. PATENT DOCUMENTS 5,235,646 A * 8/1993 Wilde et al. ..... 381/17
5,461,378 A * 10/1995 Shimoyoshi et al. ..... 341/51

(Continued)

FOREIGN PATENT DOCUMENTS

DE 19900819 7/2000

(Continued)

OTHER PUBLICATIONS

Schuijers, et al., "Advances in Parametric Audio Coding for High-Quality Audio", 114th AES (Audio Engineering Society) Convention, Mar. 2003, Amsterdam, The Netherlands, pp. 1-11.

(Continued)

*Primary Examiner* — Jesse Pullias

(57) ABSTRACT

Synthesizing an output audio signal is provided on the basis of an input audio signal, the input audio signal comprising a plurality of input sub-band signals, wherein at least one input sub-band signal is transformed (T) from the sub-band domain to the frequency domain to obtain at least one respective transformed signal, wherein the at least one input sub-band signal is delayed and transformed (D, T) to obtain at least one respective transformed delayed signal, wherein at least two processed signals are derived (P)from the at least one transformed signal and the at least one transformed delayed signal, wherein the processed signals are inverse transformed ($T^{-1}$) from the frequency domain to the sub-band domain to obtain respective processed sub-band signals, and wherein the output audio signal is synthesized from the processed sub-band signals.

6 Claims, 5 Drawing Sheets

U.S. PATENT DOCUMENTS

| | | | | |
|---|---|---|---|---|
| 5,555,306 | A * | 9/1996 | Gerzon | 381/63 |
| 5,774,844 | A * | 6/1998 | Akagiri | 704/230 |
| 5,835,375 | A * | 11/1998 | Kitamura | 700/94 |
| 5,974,380 | A * | 10/1999 | Smyth et al. | 704/229 |
| 6,005,946 | A * | 12/1999 | Varga et al. | 381/17 |
| 6,175,631 | B1 * | 1/2001 | Davis et al. | 381/17 |
| 6,199,039 | B1 * | 3/2001 | Chen et al. | 704/229 |
| 6,487,574 | B1 * | 11/2002 | Malvar | 708/400 |
| 6,680,972 | B1 * | 1/2004 | Liljeryd et al. | 375/240 |
| 7,006,636 | B2 * | 2/2006 | Baumgarte et al. | 381/17 |

FOREIGN PATENT DOCUMENTS

| | | | |
|---|---|---|---|
| WO | 9857436 | A2 | 12/1998 |
| WO | 03007656 | A1 | 1/2003 |
| WO | 2004093495 | A1 | 10/2004 |

OTHER PUBLICATIONS

Ekstrand, "Bandwidth Extension of Audio Signals by Spectral Band Replications", Proc. 1st IEEE Benelux Workshop on model Based Processing and Coding of Audio (MPCA-2002), pp. 53-58, Leuven, Belgium, Nov. 15, 2002.

* cited by examiner

CONVERTING DECODED SUB-BAND SIGNAL INTO A STEREO SIGNAL

The invention relates to synthesizing an audio signal, and in particular to an apparatus supplying an output audio signal.

The article "Advances in Parametric Coding for High-Quality Audio", by Erik Schuijers, Werner Oomen, Bert den Brinker and Jeroen Breebaart, Preprint 5852, 114th AES Convention, Amsterdam, The Netherlands, 22-25 Mar. 2003 discloses a parametric coding scheme using an efficient parametric representation for the stereo image. Two input signals are merged into one mono audio signal. Perceptually relevant spatial cues are explicitly modeled. The merged signal is encoded by using a mono-parametric encoder. The stereo parameters Interchannel Intensity Difference (IID), the Interchannel Time Difference (ITD) and the Interchannel Cross-Correlation (ICC) are quantized, encoded and multiplexed into a bitstream together with the quantized and encoded mono audio signal. At the decoder side, the bitstream is de-multiplexed to an encoded mono signal and the stereo parameters. The encoded mono audio signal is decoded in order to obtain a decoded mono audio signal m' (see FIG. 1). From the mono time domain signal, a de-correlated signal is calculated by using a filter D 10 yielding optimum perceptual de-correlation. Both the mono time domain signal m' and the de-correlated signal d are transformed to the frequency domain. Then the frequency domain stereo signal is processed with the IID, ITD and ICC parameters by scaling, phase modifications and mixing, respectively, in a parameter processing unit 11 in order to obtain the decoded stereo pair l' and r'. The resulting frequency domain representations are transformed back into the time domain.

It is an object of the invention to advantageously synthesize an output audio signal on the basis of an input audio signal. To this end, the invention provides a method, a device, an apparatus and a computer program product as defined in the independent claims. Advantageous embodiments are defined in the dependent claims.

In accordance with a first aspect of the invention, synthesizing an output audio signal is provided on the basis of an input audio signal, the input audio signal comprising a plurality of input sub-band signals, wherein at least one input sub-band signal is transformed from the sub-band domain to the frequency domain to obtain at least one respective transformed signal, wherein the at least one input sub-band signal is delayed and transformed to obtain at least one respective transformed delayed signal, wherein at least two processed signals are derived from the at least one transformed signal and the at least one transformed delayed signal, wherein the processed signals are inverse transformed from the frequency domain to the sub-band domain to obtain respective processed sub-band signals, and wherein the output audio signal is synthesized from the processed sub-band signals. By providing a sub-band to frequency transform in a sub-band, the frequency resolution is increased. Such an increased frequency resolution has the advantage that it becomes possible to achieve high audio quality (the bandwidth of a single sub-band signal is typically much higher than that of critical bands in the human auditory system) in an efficient implementation (because only a few bands have to be transformed). Synthesizing the stereo signal in a sub-band has the further advantage that it can be easily combined with existing sub-band-based audio coders. Filter banks are commonly used in the context of audio coding. All MPEG-1/2 Layers I, II and III make use of a 32-band critically sampled sub-band filter.

Embodiments of the invention are of particular use in increasing the frequency resolution of the lower sub-bands, using Spectral Band Replication ("SBR") techniques.

In an efficient embodiment, a Quadrature Mirror Filter ("QMF") bank is used. Such a filter bank is known per se from the article "Bandwidth extension of audio signals by spectral band replication", by Per Ekstrand, Proc. 1st IEEE Benelux Workshop on Model based Processing and Coding of Audio (MPCA-2002), pp.53-58, Leuven, Belgium, Nov. 15, 2002. The synthesis QMF filter bank takes the N complex sub-band signals as input and generates a real valued PCM output signal. The idea behind SBR is that the higher frequencies can be reconstructed from the lower frequencies by using only very little helper information. In practice, this reconstruction is done by means of a complex Quadrature Mirror Filter (QMF) bank. In order to efficiently come to a de-correlated signal in the sub-band domain, embodiments of the invention use a frequency (or sub-band index)-dependent delay in the sub-band domain, as disclosed in more detail in the European patent application in the name of the Applicant, filed on 17 Apr. 2003, entitled "Audio signal generation" (Attorney's docket PHNL030447). Since the complex QMF filter bank is not critically sampled, no extra provisions need to be taken in order to account for aliasing. Note that in the SBR decoder as disclosed by Ekstrand, the analysis QMF bank consists of only 32 bands, while the synthesis QMF bank consists of 64 bands, as the core decoder runs at half the sampling frequency compared to the entire audio decoder. In the corresponding encoder, however, a 64-band analysis QMF bank is used to cover the whole frequency range.

FIG. 2 is a block-diagram of a Bandwidth Enhanced (BWE) decoder using the Spectral Band Replication (SBR) technique as disclosed in MPEG-4 standard ISO/IEC 14496-3:2001/FDAM1, JTC1/SC29/WG11, Coding of Moving Pictures and Audio, Bandwidth Extension. The core part of the bitstream is decoded by using the core decoder, which may be e.g. a standard MPEG-1 Layer III (mp3) or an AAC decoder. Typically, such a decoder runs at half the output sampling frequency (fs/2). In order to synchronize the SBR data with the core data, a delay 'D' is introduced (288 PCM samples in the MPEG-4 standard). The resulting signal is fed to a 32-band complex Quadrature Mirror Filter (QMF). This filter outputs 32 complex samples per 32 real input samples and is thus over-sampled by a factor of 2. In the High-Frequency (HF) generator (see FIG. 1), the higher frequencies, which are not covered by the core coder, are generated by replicating (certain parts of) the lower frequencies. The output of the high-frequency generator is combined with the lower 32 sub-bands into 64 complex sub-band signals. Subsequently, the envelope adjuster adjusts the replicated high frequency sub-band signals to the desired envelope and adds additional sinusoidal and noise components as denoted by the SBR part of the bitstream. The total number of 64 sub-band signals is fed through the 64-band complex QMF synthesis filter to form the (real) PCM output signal.

Application of additional transforms, in a sub-band channel, introduces a certain delay. In sub-bands where no transform and inverse transform is included, delays should be introduced to keep alignment of the sub-band signals. Without special measures, the extra delay in the sub-band signals so introduced, results in a misalignment (i.e. out of sync) of the core and side or helper data such as SBR data or parametric stereo data. In the case of the sub-bands with additional transform/inverse transform and sub-bands without additional transform, additional delay should be added to the sub-bands without transform. Within SBR, the extra delay caused by the transforming and inverse transforming operation could be deducted from the delay D.

These and other aspects of the invention are apparent from and will be elucidated with reference to the embodiments described hereinafter.

The drawings only show those elements that are necessary to understand the invention.

Figure 3:
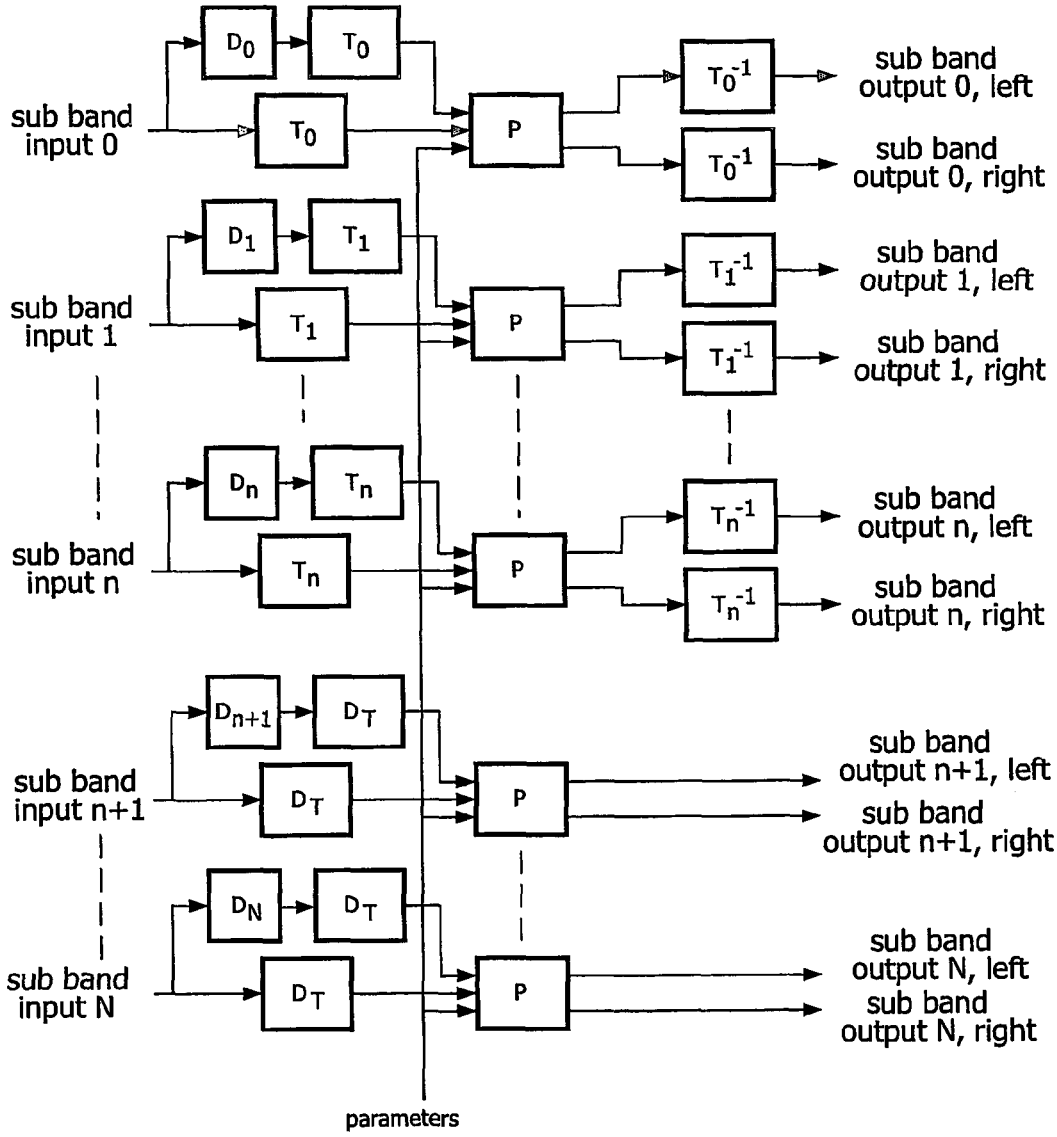
FIG. 3 shows parametric stereo processing in the sub-band domain in accordance with an embodiment of the invention.

FIG. 3 shows parametric stereo processing in the sub-band domain in accordance with an embodiment of the invention. The input signal consists of N input sub-band signals. In practical embodiments, N is 32 or 64. The lower frequencies are transformed, using transform T to obtain a higher frequency resolution, the higher frequencies are delayed, using delay $D_T$ to compensate for the delay introduced by the transform. From each sub-band signal, also a de-correlated sub-band signal is created by means of delay-sequence $D_x$ where x is the sub-band index. The blocks P denote the processing into two sub-bands from one input sub-band signal, the processing being performed on one transformed version of the input sub-band signal and one delayed and transformed version of the input sub-band signal. The processing may comprise mixing, e.g. by matrixing and/or rotating, the transformed version and the transformed and delayed version. The transform $T^{-1}$ denotes the inverse transform. $D_T$ may be split before and after block P. Transforms T may be of different length, typically low frequency has a longer transform, which means that additionally a delay should also be introduced in the paths where the transform is shorter than the longest transform. The delay D in front of the filter bank may be shifted after the filter bank. When it is placed after the filter bank, it can be partially removed because the transforms already incorporate a delay. The transform is preferably of the Modified Discrete Cosine Transform ("MDCT") type, although other transforms such as Fast Fourier Transform may also be used. The processing P does not usually give rise to additional delay.

Figure 1:
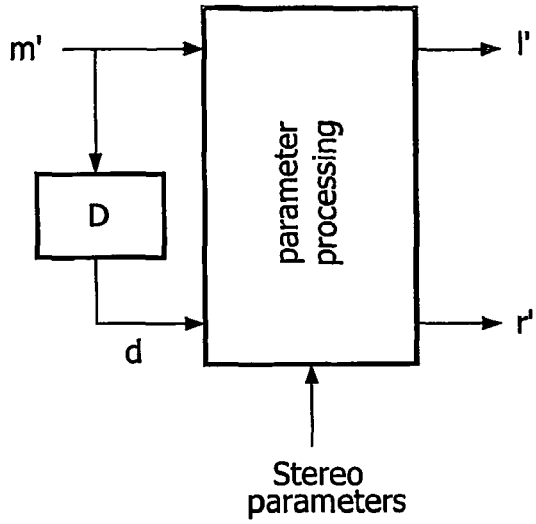
FIG. 1 is a block diagram of a parametric stereo decoder.
Figure 2:
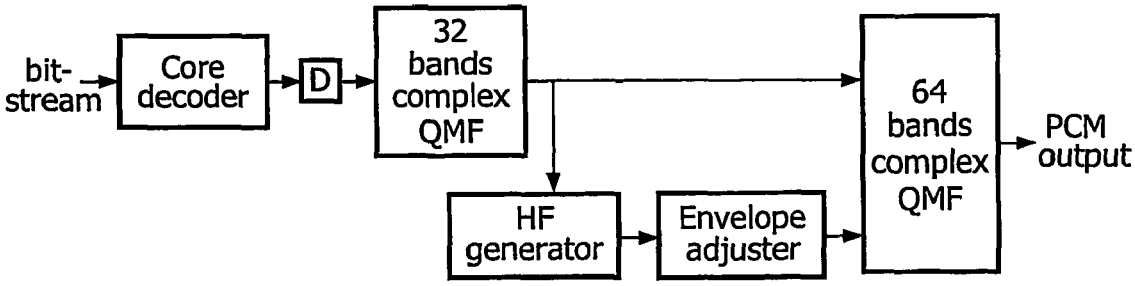
FIG. 2 is a block diagram of an audio decoder using SBR technology.
Figure 4:
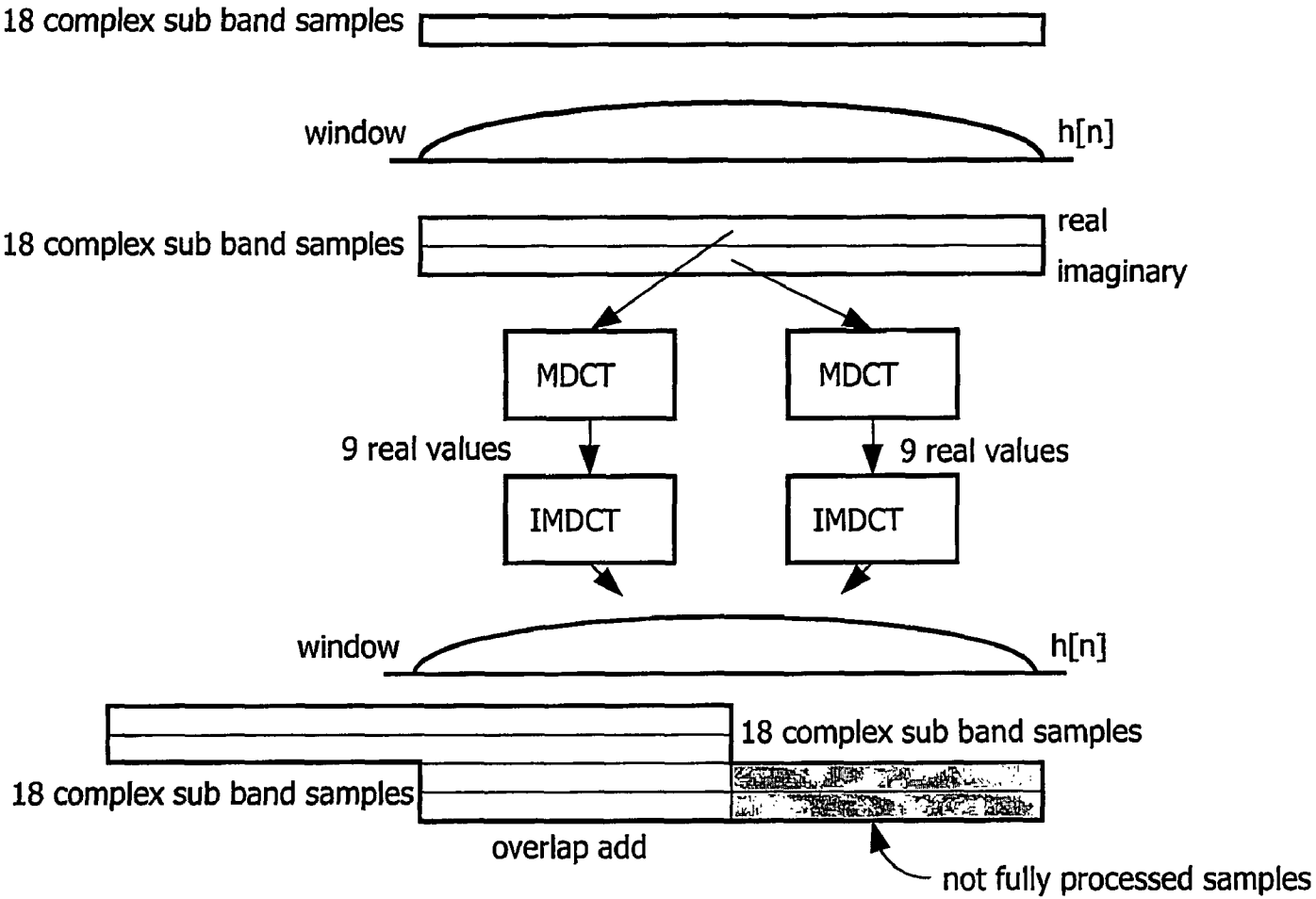
FIG. 4 is a block diagram illustrating the delay caused by transform-inverse transform $TT^{-1}$ of FIG. 3.

FIG. 4 is a block diagram illustrating the delay caused by transform-inverse transform $TT^{-1}$ of FIG. 3. In FIG. 4, 18 complex sub-band samples are windowed by a window h[n]. The complex signals are then split into the real and imaginary part, which are both transformed, using the MDCT into two times 9 real values. The inverse transform of both sets of 9 values again leads to 18 complex sub-band samples that are windowed and overlap-added with the previous 18 complex sub-band samples. As illustrated in this Figure, the last 9 complex sub-band samples are not fully processed (i.e. overlap-added), leading to an effective delay of half the transform length, i.e. 9 (sub-band) samples. Consequently, the delay in a single sub-band filter should be compensated in all other sub-bands where no transformation is applied. However, introducing an extra delay to the sub-band signals prior to SBR processing (i.e. HF generation and envelope adjustment) results in a misalignment of the core and SBR data. In order to preserve this alignment, the PCM delay D as shown in FIG. 2 can be placed just after the M-band complex analysis QMF, which effectively results in a delay of D/M in each sub-band. Thus, the requirement for alignment of the core and SBR data is that the delay in all sub-bands amounts to D/M. Therefore, as long as the delay DT of the added transformation is equal to or smaller than D/M, synchronization can be preserved. Note that the delay elements in the sub-band domain become of the complex type. In practical SBR embodiments, M=32. M may also be equal to N.

Note that in practical embodiments, each transform T comprises two MDCTs and each inverse transform $T^{-1}$ comprises two IMDCTs, as described above.

The lower sub-bands, in which the transformation T is introduced, are covered by the core decoder. However, although they are not processed by the envelope adjuster of the SBR tool, the high-frequency generator of the SBR tool may require their samples in the replication process. Therefore, the samples of these lower sub-bands also need to be available as 'non-transformed'. This requires an extra (again complex) delay of DT sub-band samples in these sub-bands. The mixing operation performed on the real values and on the complex values of the complex samples may be equal.

Figure 5:
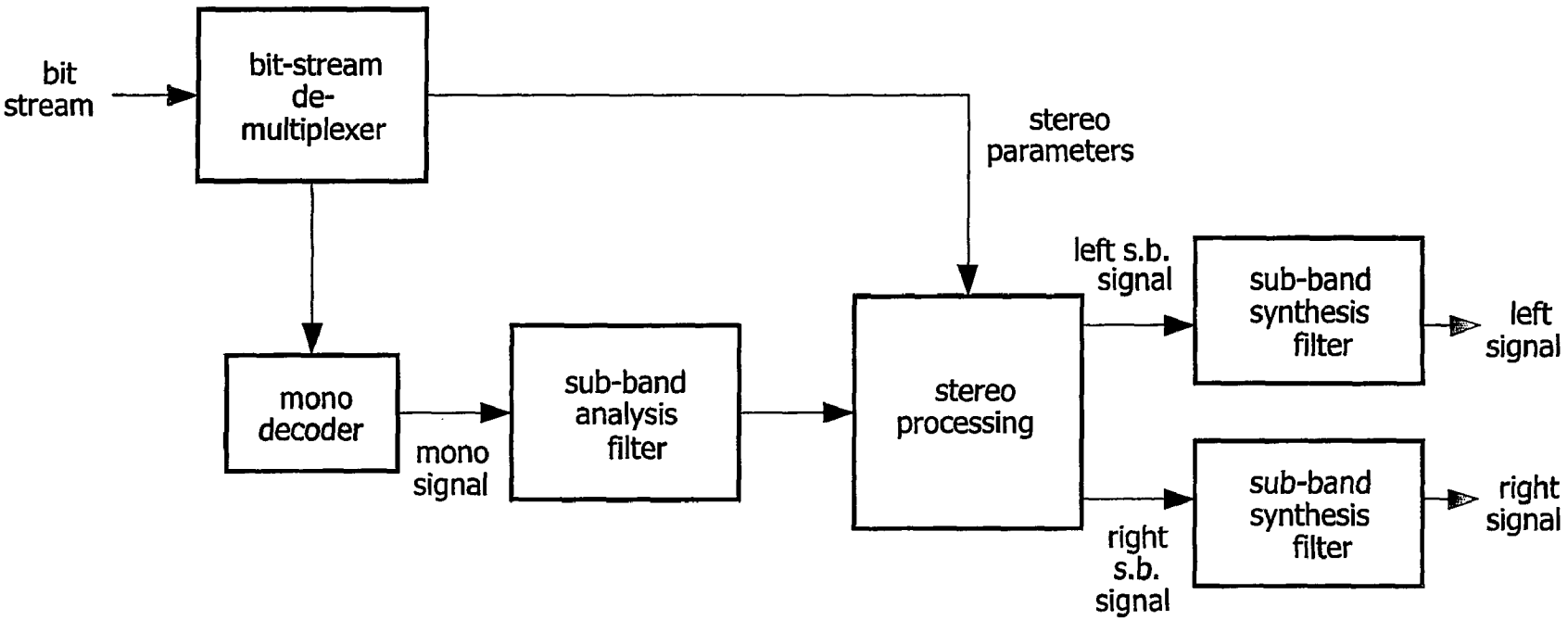
FIG. 5 shows an advantageous audio decoder in accordance with an embodiment of the invention, which provides parametric stereo.

FIG. 5 shows an advantageous audio decoder in accordance with an embodiment of the invention, which provides parametric stereo. The bitstream is split into mono parameters/coefficients and stereo parameters. First, a conventional mono decoder is used to obtain the (backwards compatible) mono signal. This signal is analyzed by means of a sub-band filter bank splitting the signal into a number of sub-band signals. The stereo parameters are used to process the sub-band signals to two sets of sub-band signals, one for the left and one for the right channel. Using two sub-band synthesis filters, these signals are transformed to the time domain resulting in a stereo (left and right) signal. The stereo processing block is shown in FIG. 3.

Figure 6:
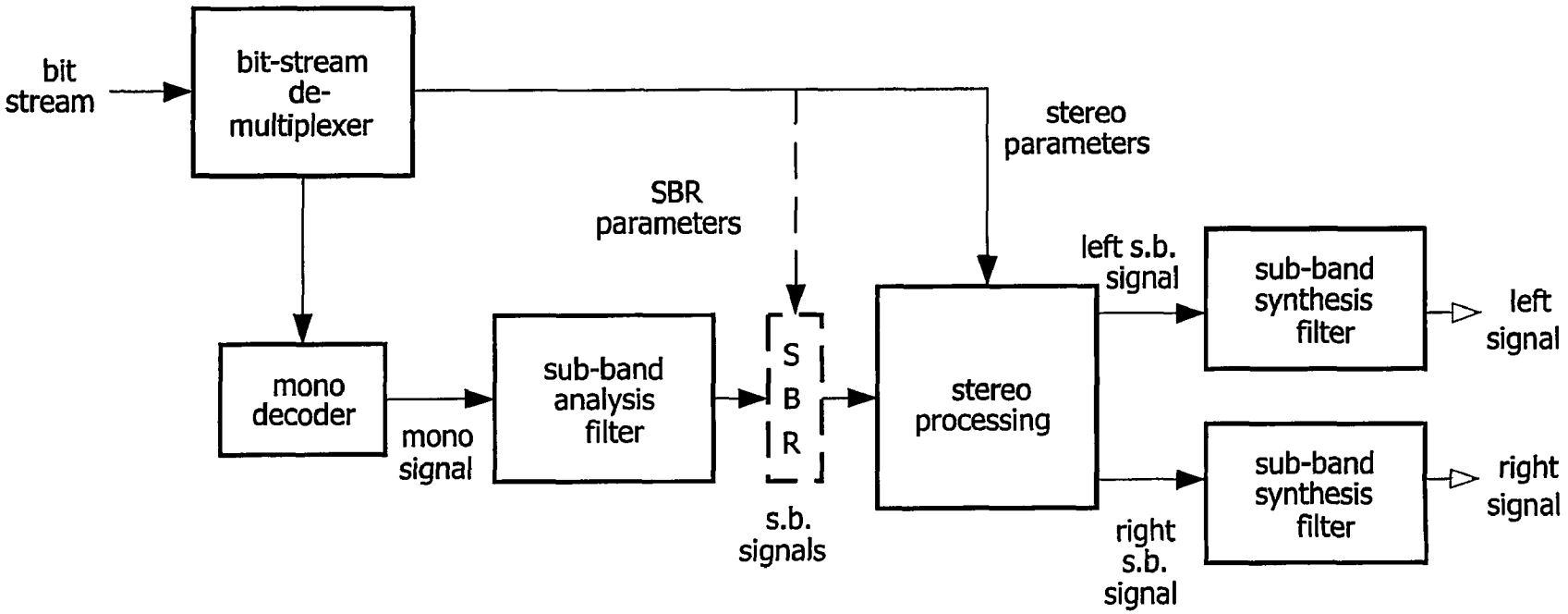
FIG. 6 shows an advantageous audio decoder in accordance with an embodiment of the invention, which combines parametric stereo with SBR.

FIG. 6 shows an advantageous audio decoder in accordance with an embodiment of the invention, which combines parametric stereo with SBR. The bitstream is split into mono parameters/coefficients, SBR parameters and stereo parameters. First, a conventional mono decoder is used to obtain the (backwards compatible) mono signal. This signal is analyzed by means of a sub-band filter bank splitting the signal into a number of sub-band signals. By using the SBR parameters, more HF content is generated, possibly using more sub-bands than the analysis filter bank. The stereo parameters are used to process the sub-band signals to two sets of sub-band signals, one for the left and one for the right channel. By using two sub-band synthesis filters, these signals are transformed to the time domain resulting in a stereo (left and right) signal. The stereo processing block is shown in the block diagram of FIG. 3.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the indefinite article "a" or "an" preceeding an element or step does not exclude the presence of a plurality of such elements or steps. Use of the verb 'comprise' and its conjugations does not exclude the presence of elements or steps other than those stated in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method for generating a wideband time domain output audio signal comprising a left hand audio signal component and a right hand signal component from a wideband time domain input audio signal, the method comprising the steps of:

transforming the wideband time domain input audio signal to a sub-band domain input signal comprising a plurality of input sub-band signals, the input sub-band signals in a first frequency range of the wideband frequency range having a narrower frequency band than the input sub-band signals in a second frequency range of the wideband frequency range;

delaying the sub-band signals so as to obtain delayed sub-band signals;

deriving a first and a second processed sub-band signal by mixing a sub-band signal and a corresponding delayed sub-band signal;

inverse transforming the first processed sub-band signals so as to obtain the left hand audio signal component of the wideband time domain output audio signal, and inverse transforming the second processed sub-and signals so as to obtain the right hand audio signal component of the wideband time domain output audio signal.

2. A device for generating a wideband time domain output audio signal comprising a left hand audio signal component and a right hand signal component from a wideband time domain input audio signal, the device comprising:

a transformer unit for transforming (T) the wideband time domain input audio signal into a sub-band domain input signal comprising a plurality of input sub-band signals, the input sub-band signals in a first frequency range of the wideband frequency range having a narrower frequency band than the input sub-band signals in a second frequency range of the wideband frequency range;

a delay unit for delaying the sub-band signals so as to obtain delayed sub-band signals;

a mixing unit for deriving a first and a second processed signal by mixing a sub-band signal and a corresponding delayed sub-band signal; and an inverse transformation unit for inverse transforming the first processed sub-band signals so as to obtain the left hand audio signal component of the wideband time domain output audio signal, and for inverse transforming the second processed sub-band signals so as to obtain the right hand audio signal component of the wideband time domain output audio signal.

3. The device as claimed in claim 2, wherein the first frequency range is a low frequency portion of the wideband frequency range and the second frequency range is a high frequency portion of the wideband frequency range.

4. The device as claimed in claim 2, wherein the transformation unit comprises:

a first transformation block for transforming the wideband time domain input audio signal into a plurality of narrow band sub-band signals in said first and second frequency range;

a second transformation block for transforming the narrow band sub-band signals in said first frequency range into the input sub-band signals in said first frequency range, the bandwidth of the input sub-band signals in said first frequency range being smaller than the bandwidth of the narrow band sub-band signals in said first frequency range; and a delay block for delaying the narrow band sub-signals in the second frequency range so as to obtain the input sub-band signals in said second frequency range, and wherein the inverse transformation unit comprises:

a first inverse transformation block for inverse transforming the first processed sub-band signals in said first frequency range into first processed narrow band sub-band signals in said first frequency range, the bandwidth of the first processed narrow band sub-band signals being larger than the bandwidth of the first processed sub-band signals;

a second inverse transformation block for inverse transforming the second processed sub-band signals in said first frequency range into second processed narrow band sub-band signals in said first frequency range, the bandwidth of the second processed narrow band sub-band signals being larger than the bandwidth of the second processed sub-band signals;

a third inverse transformation block for inverse transforming the first processed narrow band sub-band signals in said first frequency range and the first processed sub-band signals in said second frequency range into said left hand audio signal component of the wideband time domain audio output signal; and a fourth inverse transformation block for inverse transforming the second processed narrow band sub-band signals in said first frequency range and the second processed sub-band signals in said second frequency range into said right hand audio signal component of the wideband time domain output audio signal.

5. The device as claimed in claim 2, wherein the mixing unit derives the first and a second processed sub-band signal from the sub-band signal and the corresponding delayed sub-band signal under the influence of parameter signals.

6. The device as claimed in claim 5, wherein the mixing unit derives the first processed sub-band signal by combining, in a first combining step, the sub-band signal and the corresponding delayed sub-band signal under the influence of the parameter signals, and derives the second processed sub-band signal by combining, in a second combining step, the sub-band signal and the corresponding delayed sub-band signal under the influence of the parameter signals, said combining steps including scaling and/or phase modifying the sub-band signal and the corresponding delayed sub-band signal.

* * * * *